US010141140B2

(12) United States Patent
Park

(10) Patent No.: US 10,141,140 B2
(45) Date of Patent: Nov. 27, 2018

(54) AIR CIRCUIT BREAKER

(71) Applicant: LSIS CO., LTD., Anyang-si, Gyeonggi-do (KR)

(72) Inventor: Woojin Park, Anyang-si (KR)

(73) Assignee: LSIS CO., LTD., Ayang-si, Gyeonggi-Do (KR)

( * ) Notice: Subject to any disclaimer, the term of this patent is extended or adjusted under 35 U.S.C. 154(b) by 0 days.

(21) Appl. No.: 15/616,850

(22) Filed: Jun. 7, 2017

(65) Prior Publication Data

US 2018/0158629 A1 Jun. 7, 2018

(30) Foreign Application Priority Data

Dec. 5, 2016 (KR) ..... 10-2016-0164519

(51) Int. Cl.

| | |
|---|---|
| ***H01H 33/06*** | (2006.01) |
| ***H01H 33/02*** | (2006.01) |
| ***H01H 33/60*** | (2006.01) |
| ***H01H 1/22*** | (2006.01) |
| *H01H 73/04* | (2006.01) |

(52) U.S. Cl.

CPC ..... *H01H 33/06* (2013.01); *H01H 1/225* (2013.01); *H01H 1/226* (2013.01); *H01H 33/021* (2013.01); *H01H 33/60* (2013.01); *H01H 73/04* (2013.01); *H01H 2001/228* (2013.01)

(58) Field of Classification Search

CPC ..... H01H 1/226; H01H 1/06; H01H 3/46; H01H 9/30; H01H 33/04; H01H 33/06; H01H 33/021; H01H 73/06; H01H 73/18; H01H 1/50; H01H 77/104

USPC ..... 218/89, 16, 17, 20, 43, 78, 107; 200/304, 400, 401, 441, 50.27; 335/201, 335/202, 15

See application file for complete search history.

(56) References Cited

U.S. PATENT DOCUMENTS

| | | | | |
|---|---|---|---|---|
| 4,926,016 A * | 5/1990 | Leone | ..... | H01H 1/226 218/147 |
| 5,899,323 A * | 5/1999 | Rakus | ..... | H01H 1/226 200/244 |
| 7,187,258 B2 | 3/2007 | Yamazaki et al. | | |

(Continued)

FOREIGN PATENT DOCUMENTS

| | | |
|---|---|---|
| CN | 101533741 | 9/2009 |
| CN | 105762038 | 7/2016 |

(Continued)

OTHER PUBLICATIONS

Korean Intellectual Property Office Search report dated Sep. 13, 2016, 4 pages.

(Continued)

*Primary Examiner* — Edwin A. Leon
*Assistant Examiner* — William Bolton
(74) *Attorney, Agent, or Firm* — K&L Gates LLP

(57) ABSTRACT

The present invention relates to an air circuit breaker, in which a recess is formed on one side or each of both sides of each contact plate provided in an insulating cage so as to reduce a contact area between a movable contactor and the contact plate when the movable contactor and the contact plate are brought into contact with each other, thereby preventing a contact portion between the movable contactor and the contact plate from being melted due to heat generation.

9 Claims, 11 Drawing Sheets

(56) References Cited

U.S. PATENT DOCUMENTS

| | | | | |
|---|---|---|---|---|
| 7,473,862 | B2 * | 1/2009 | Seo | H01H 1/226 200/400 |
| 8,178,804 | B2 * | 5/2012 | Park | H01H 1/226 200/304 |
| 8,264,306 | B2 * | 9/2012 | Baek | H01H 77/10 335/15 |
| 9,087,665 | B2 * | 7/2015 | Fong | H01H 1/226 |
| 2014/0009250 | A1 * | 1/2014 | Cho | H01H 1/226 335/192 |
| 2016/0352084 | A1 | 12/2016 | Herreros et al. | |

FOREIGN PATENT DOCUMENTS

| | | | |
|---|---|---|---|
| CN | 105762038 | A | 7/2016 |
| EP | 0358289 | A2 | 3/1990 |
| EP | 2187421 | A1 | 5/2010 |
| JP | H05101765 | | 4/1993 |
| JP | H07249361 | | 9/1995 |
| JP | 2001357769 | | 12/2001 |
| JP | 2003162949 | | 6/2003 |
| JP | 2009289451 | | 12/2009 |
| KR | 1020060063418 | | 6/2006 |
| KR | 10-0771919 | B1 | 11/2007 |
| KR | 20-2014-000276 | U | 1/2014 |
| KR | 20-2014-0002763 | U | 1/2014 |
| WO | 02/027739 | A1 | 4/2002 |
| WO | 02/27739 | A1 | 4/2002 |

OTHER PUBLICATIONS

Extended European Search Report dated Feb. 10, 2017 for related European Patent Application No. 17171356.3.

Korean Office Action dated Dec. 19, 2017 for related Korean Application No. 10-2016-0164519.

* cited by examiner

AIR CIRCUIT BREAKER

CROSS-REFERENCE TO RELATED APPLICATION

Pursuant to 35 U.S.C. § 119(a), this application claims the benefit of earlier filing date and right of priority to Korean Application No. 10-2016-0164519, filed on Dec. 5, 2016, the contents of which are all hereby incorporated by reference herein in its entirety.

BACKGROUND OF THE INVENTION

1. Field of the Invention

This specification relates to an air circuit breaker, and more particularly, an air circuit breaker capable of preventing a contact portion between a movable contactor and a contact plate from being melted due to heat generated at the contact portion resulting from an introduction of a fault current while a current flows.

2. Background of the Invention

In general, a circuit breaker refers to an apparatus of opening and closing a load or cutting off a current when a fault such as ground, short-circuit or the like occurs in a transmission and substation system or an electric circuit.

In addition, a circuit breaker with a breaking part insulated by an insulating material protects a power system and a load device by manually opening or closing an electric line in a normal use state or opening and closing such line at a remote distance by an electric operation device outside a metal container, etc, or automatically breaking a line upon an occurrence of an overload or short-circuit.

In order to break the electric line, a fixed contactor and a movable contactor are provided in a breaking part of the circuit breaker. Accordingly, the fixed contactor and the movable contactor are normally brought into contact with each other so as to allow a current to flow. When a large current flows due to a failure occurred somewhere in the line, the movable contactor is separated from the fixed contactor to cut off the current.

Depending on a manner of operating a breaking part, circuit breakers are classified into an air operation type (mode), a hydraulic operation type, and a spring operation type. First, the air operation type has a simple structure and can obtain a large operation force. However, this type requires for operating compressed air, has a difficulty in maintenance of an operation device, and causes a lowered performance depending on temperature.

Next, the hydraulic operation type requires for high fabricating costs because of employing a hydraulic cylinder, a pump, a hydraulic accumulator, etc., which should be maintained in an airtight state through ultra-precise processing.

In addition, the hydraulic operation type causes deviations (errors) of an operation time of the circuit breaker and speed of the movable contactor due to an oil leakage caused by a long-term use. This results in lowering a breaking performance. Accordingly, a reliable current breaking operation can not be ensured.

Finally, the spring operation type is derived to overcome the problems of the air operation type and the hydraulic operation type.

The spring operation type uses spring force as an energy source for opening and closing a circuit. The spring operation type may facilitate maintenance of operation force and management of an operation device rather than the air and hydraulic operation types, and minimize deviations of response speed and response time through a mechanical configuration. Thus, the spring operation type is widely employed as a method of operating the breaking part.

On the other hand, when a current flow is cut off in response to the movable contactor being separated from the fixed contactor, an arc is generated.

The generated arc should be promptly extinguished to prevent damage on a contact of the movable contactor. According to the arc extinguishing method, circuit breakers are classified into an air circuit breaker (ACB) extinguishing an arc by blowing air and a gas circuit breaker (GCB) extinguishing an arc by blowing gas.

In this instance, the air circuit breaker is installed at the uppermost part of a low-pressure water distribution system, and thus greatly requires for durability to ensure a stable structure against a thermal shock occurred at the contact for a predetermined time even when a fault current is introduced.

FIG. 1 is a perspective view illustrating a breaking part of the related art air circuit breaker, FIG. 2 is an exploded perspective view illustrating the breaking part of the related art air circuit breaker, and FIG. 3 is a cross-sectional view schematically illustrating a contact state between a movable contact and a fixed contact in the breaking part of the related art air circuit breaker.

Also, FIG. 4 is a front view illustrating a state in which movable contactors are inserted between adjacent contact plates of the related art air circuit breaker, FIG. 5 is a front view illustrating a heat generating position between the movable contactor and the contact plate of the related art air circuit breaker, FIG. 6 is a perspective view illustrating a state in which the contact plates are provided in an insulating cage constituting the related art air circuit breaker, FIG. 7 is a schematic view illustrating relative positions of the movable contactor and the contact plate in a state before a movable contact and a fixed contact are brought into contact with each other in the related art air circuit breaker, and FIG. 8 is a schematic view illustrating relative positions of the movable contactor and the contact plate in a state where the movable contact and the fixed contact are brought into contact with each other in the related art air circuit breaker.

As illustrated in FIGS. 1 to 3 and 6, the related art air circuit breaker is provided with a breaking part 10 formed of an insulating material and allowing current to flow or be cut off. The breaking part 10 includes fixed contactors 11 fixed to one side of the breaking part 10, and movable contactors 14 brought into contact with or separated from the fixed contactors 11 according to an operation of a switching mechanism (not illustrated).

The fixed contactor 11 is connected to an input side terminal 12 through which a current is introduced, and provided with a fixed contact 11*a* at one end thereof.

Also, the breaking part 10 is provided with an insulating cage 15 having a fixed lower portion of one side thereof and rotatable another side so as to be rotatable through connection pins 19 by a connection link 16 connected to the switching mechanism, a load side terminal 13 provided at one side of the insulating cage 15, and a plurality of braided wires provided within the insulating cage 15, connected to the load side terminal 13, and arranged in series toward another side of the insulating cage 15.

The breaking part 10 is further provided with movable contactors 14 disposed within the insulating cage 15, each having one end connected to the corresponding braided wire 18 and another end protruding from another side of the insulating cage 15, and each provided with a movable contact 14*a* on an upper portion thereof, contact springs 17 provided within the another side of the insulating cage 15 and elastically supporting lower ends of the movable contactors 14, and the like.

As illustrated in FIGS. 4, 5, 7, and 8, when the air circuit breaker is switched from a trip (OFF) state into a turn-on (ON) state, the movable contactors 14 are moved to the fixed contactors 11, in response to an operation of the switching mechanism, such that the movable contacts 14*a* are brought into contact with fixed contacts 11*a*. In this instance, as the movable contactors 14 are moved toward the insulating cage 15, the movable contactors 14 are inserted between the plurality of contact plates 20 provided within the insulating cage 15 and brought into contact with the plurality of contact plates 20.

At this time, even if a fault current flows into the air circuit breaker through the movable contacts 14*a* and the fixed contacts 11*a*, the air circuit breaker should be maintained in the ON state for a predetermined time. When the fault current is introduced, heat is generated at each of contact portions A between the movable contactors 14 and the contact plates 20. The generated heat melts the contact portions between the movable contactors 14 and the insulating plates 20, which results in interfering with a rotation of the movable contactors 14. This causes a problem that the movable contactors 14 fail to normally operate.

SUMMARY OF THE INVENTION

Therefore, an aspect of the detailed description is to provide an air circuit breaker, capable of preventing a contact portion between a movable contactor and a contact plate from being melted due to heat generated at the contact portion caused by an introduction of a fault current while the air circuit breaker is in an ON state.

To achieve these and other advantages and in accordance with the purpose of this specification, as embodied and broadly described herein, there is provided an air circuit breaker including an insulating cage provided with a plurality of contact plates, movable contactors each inserted between the adjacent contact plates, and fixed contactors brought into contact with or separated from the movable contactors in response to a movement of the movable contactors, wherein each of the contact plates is provided with a recess.

The recess is formed on each of both side surfaces of the contact plate.

The recess is located at a position adjacent to a contact portion between the movable contactor and the fixed contactor in a state that the movable contactor and the fixed contactor are brought into contact with each other.

The recess is inclined inward the contact plate from rear to front sides of the contact plate.

The recess has a rectangular or circular section.

The recess is provided in plurality, and a depth of each of the recesses changes as the recess extends from the rear to front sides of the contact plate.

The contact plate and the insulating cage are made of different materials from each other.

The contact plate is made of a material having relatively higher thermal resistance than that of the insulating cage.

The contact plate is made of a thermosetting or thermoplastic resin composite.

The insulating cage is made of a thermosetting or thermoplastic resin composite.

As described so far, an air circuit breaker according to the present invention may have a recess provided on one or each of both side surfaces of each contact plate provided in an insulating cage so as to reduce a contact area of a contact portion between a movable contactor and the contact plate when the movable contactor and the contact plate are in a contact state, thereby preventing the contact portion from being melted due to heat generated.

The recess may be located adjacent to a contact portion between the movable contactor and a fixed contactor where the largest amount of heat is generated upon an introduction of a fault current, thereby efficiently preventing melting due to heat generated at the contact portion.

The recess may be inclined inwardly from rear to front sides of the contact plate so as to increase an inward depth as getting close to a position where contacts of the movable contactor and the fixed contactor are brought into contact with each other, thereby minimizing an affection of the heat generated at the contacted position of the contacts to the contact portion between the movable contactor and the contact plate.

The contact plate may be made of thermosetting resin so as to be prevented from being melted due to the heat generated around the contact portion upon the introduction of the fault current.

Since the contact plate can be prevented from being melted, it is possible to prevent a failure of a rotation of the movable contactor due to the movable contact being fused on the contact plate, caused by the melted contact plate 110.

Also, upon the fabrication of a breaking part, the contact plate made of the thermosetting resin may first be molded and the insulating cage made of thermoplastic resin may finally be molded, thereby facilitating the insertion operation of the contact plate.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

Figure 12:
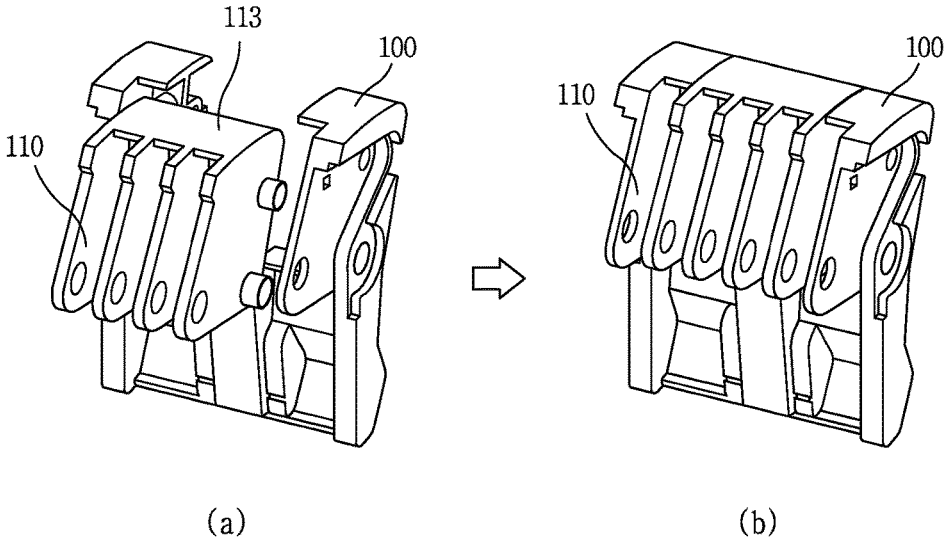
Figure 13:
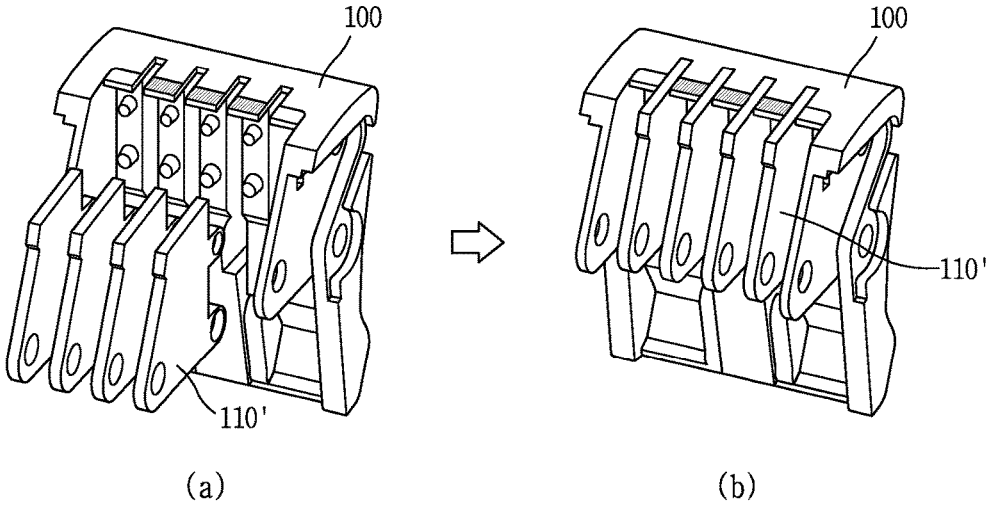
Figure 14:
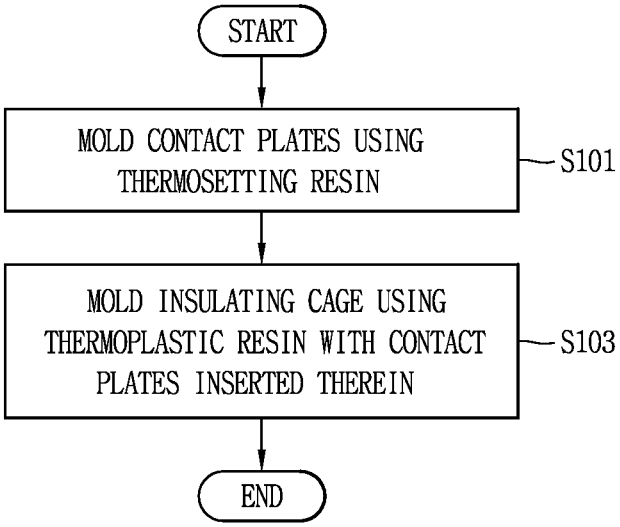

(a) of FIG. 12 is a perspective view illustrating a state before the contact plates and the insulating case provided in the air circuit breaker according to the one embodiment are coupled to each other;

(b) of FIG. 12 is a perspective view illustrating a state where the contact plates and the insulating cage provided in the air circuit breaker according to the one embodiment are coupled to each other;

(a) of FIG. 13 is a perspective view illustrating a state before the contact plates and the insulating cage provided in the air circuit breaker according to the another embodiment are coupled to each other;

(b) of FIG. 13 is a perspective view illustrating a state where the contact plates and the insulating cage provided in the air circuit breaker according to the another embodiment are coupled to each other; and FIG. 14 is a flowchart illustrating a process of fabricating a breaking part of an air circuit breaker in accordance with one embodiment of the present invention.

DETAILED DESCRIPTION OF THE INVENTION

Description will now be given in detail of an air circuit breaker according to exemplary embodiments disclosed herein, with reference to the accompanying drawings.

Figure 1:
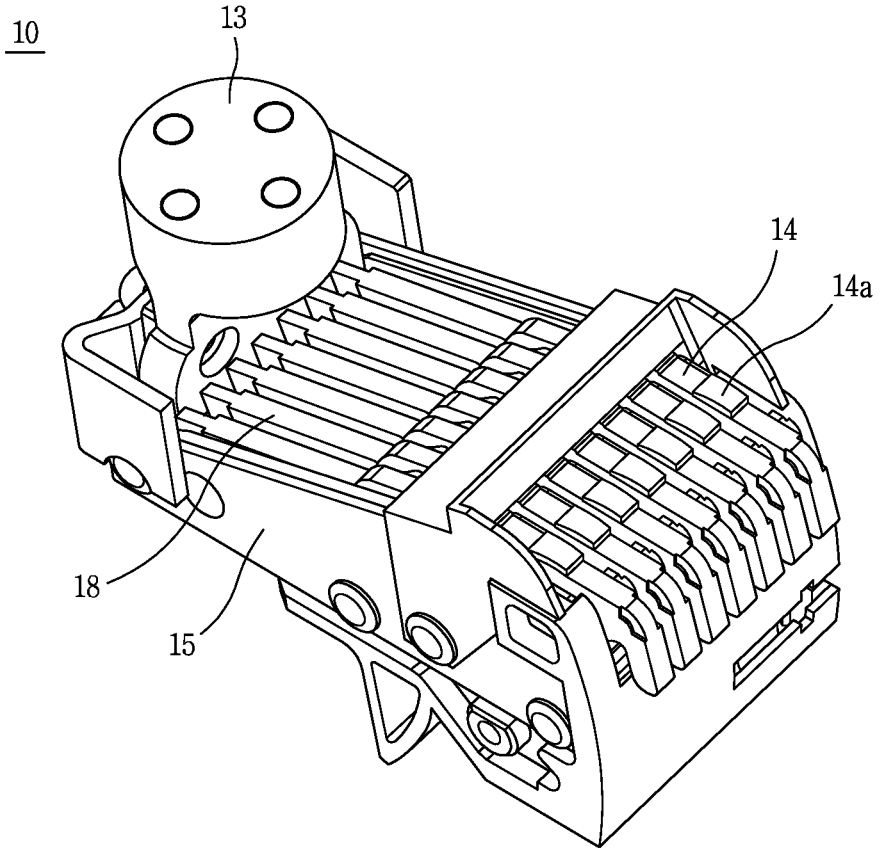
FIG. 1 RELATED ART
FIG. 1 is a perspective view illustrating a breaking part of the related art air circuit breaker.
Figure 2:
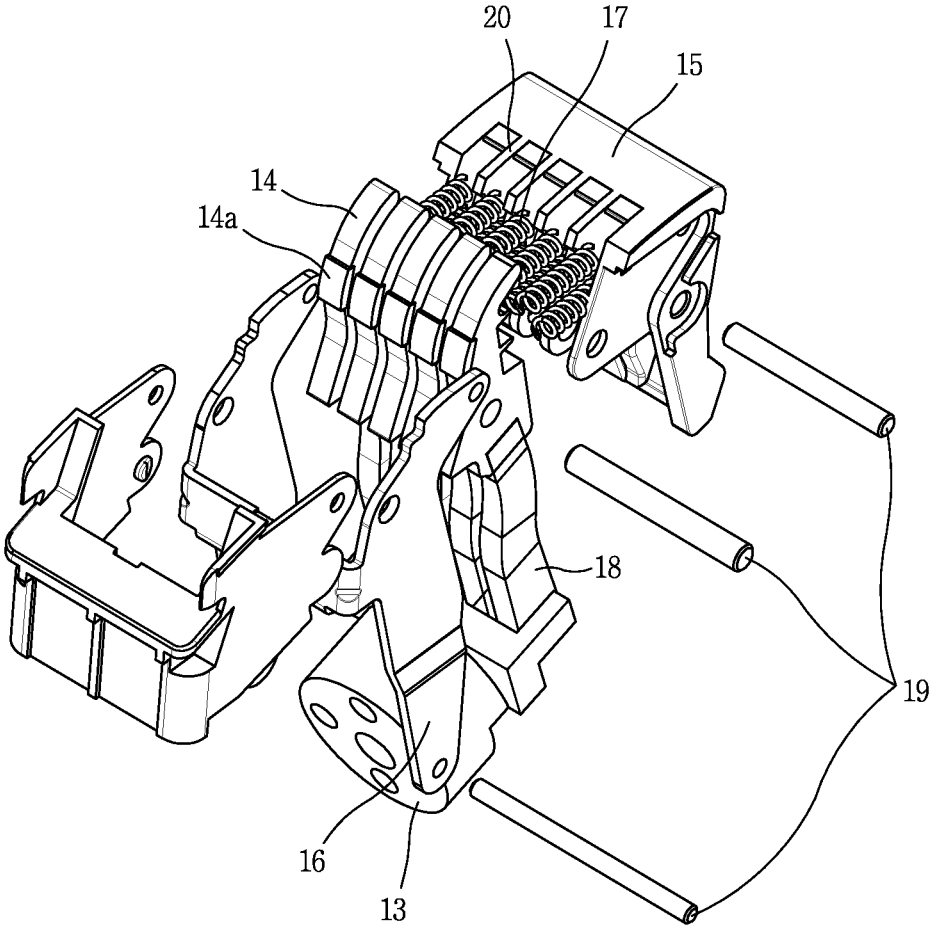
FIG. 2 RELATED ART
FIG. 2 is an exploded perspective view illustrating the breaking part of the related art air circuit breaker.
Figure 3:
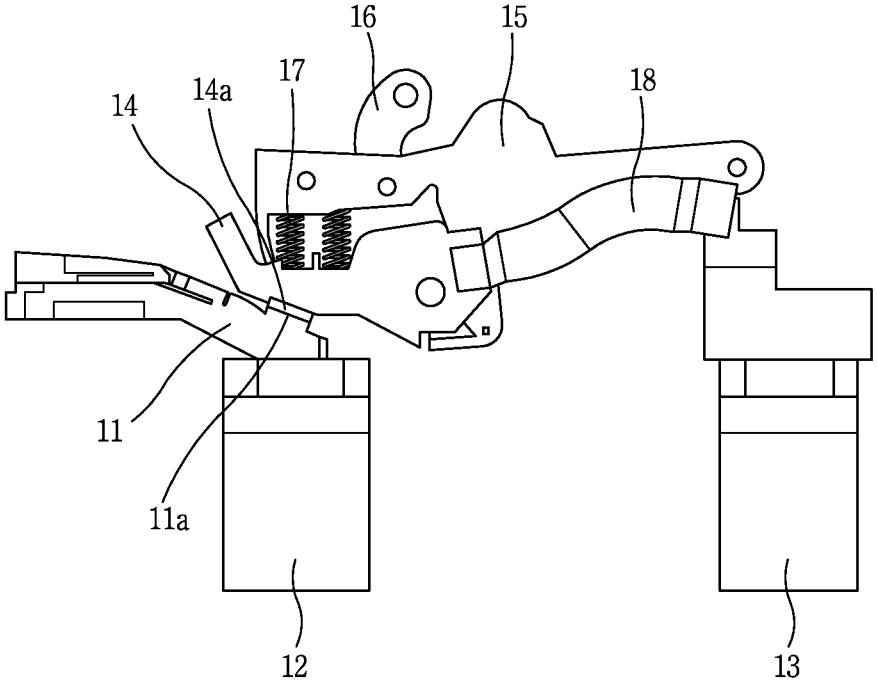
FIG. 3 RELATED ART
FIG. 3 is a cross-sectional view schematically illustrating a contact state between a movable contact and a fixed contact in the breaking part of the related art air circuit breaker.
Figure 4:
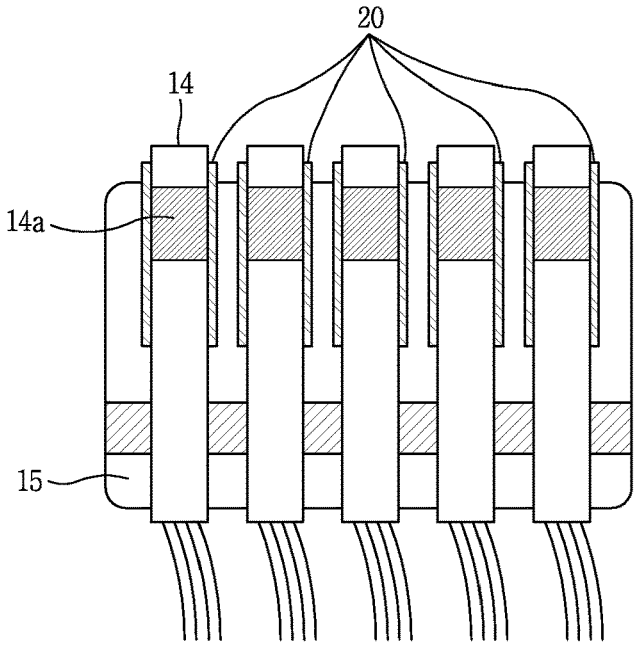
FIG. 4 RELATED ART
FIG. 4 is a front view illustrating a state in which a movable contactor is inserted between contact plates of the related art air circuit breaker.
Figure 5:
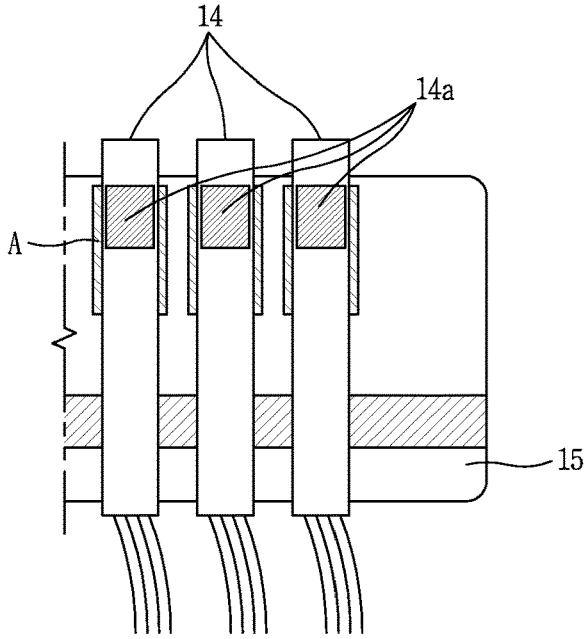
FIG. 5 RELATED ART
FIG. 5 is a front view illustrating a heat generating position between the movable contactor and the contact plate of the related art air circuit breaker.
Figure 6:
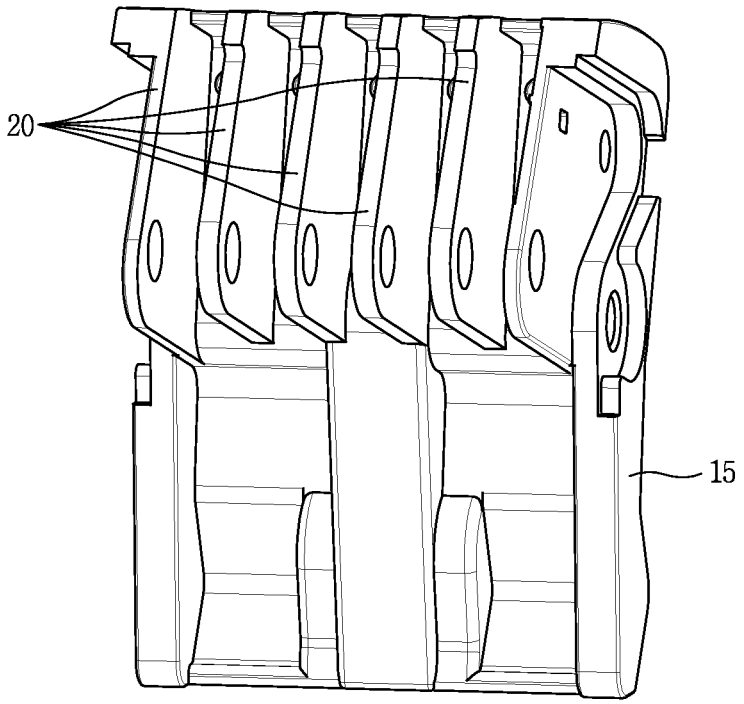
FIG. 6 RELATED ART
FIG. 6 is a perspective view illustrating a state in which the contact plates are provided in an insulating cage constituting the related art air circuit breaker.
Figure 7:
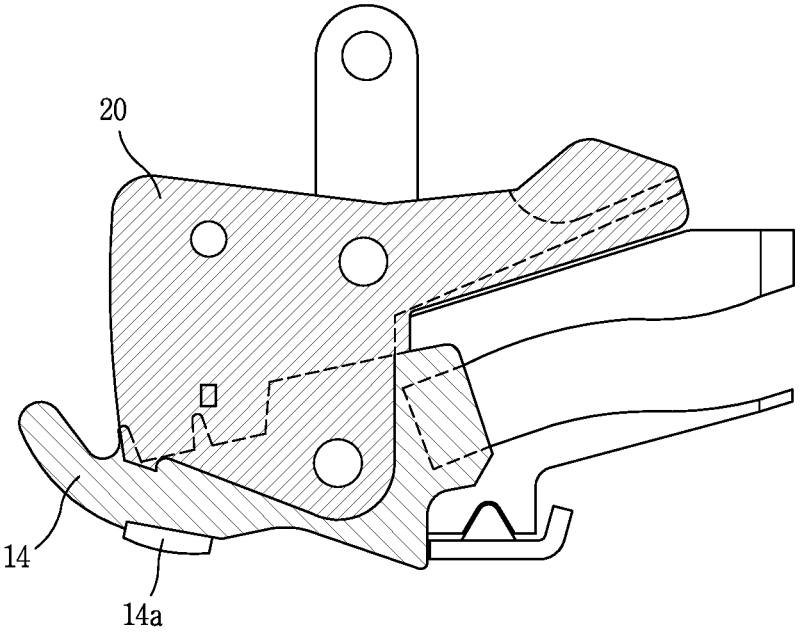
FIG. 7 RELATED ART
FIG. 7 is a schematic view illustrating relative positions of the movable contactor and the contact plate in a state before a movable contact and a fixed contact are brought into contact with each other in the related art air circuit breaker.
Figure 8:
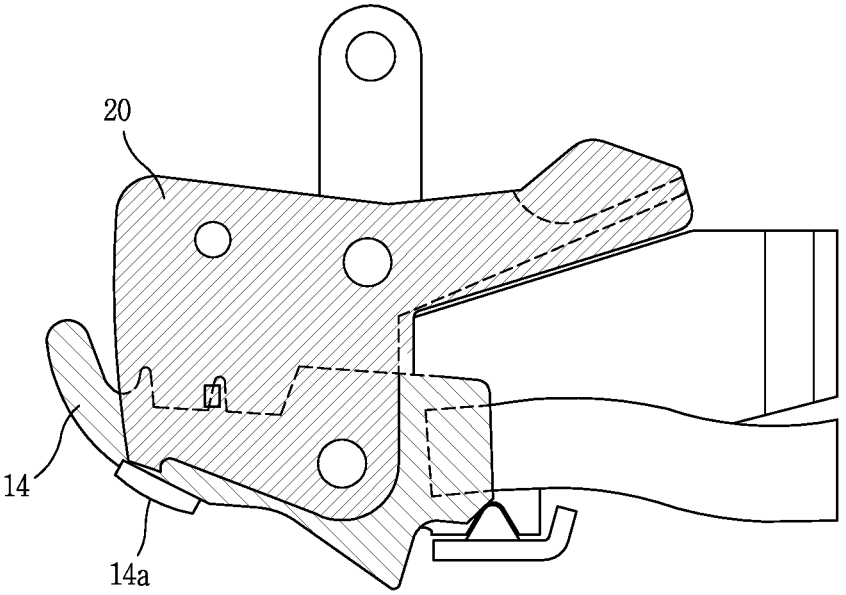
FIG. 8 RELATED ART
FIG. 8 is a schematic view illustrating relative positions of the movable contactor and the contact plate in a state where the movable contact and the fixed contact are brought into contact with each other in the related art air circuit breaker.
Figure 9:
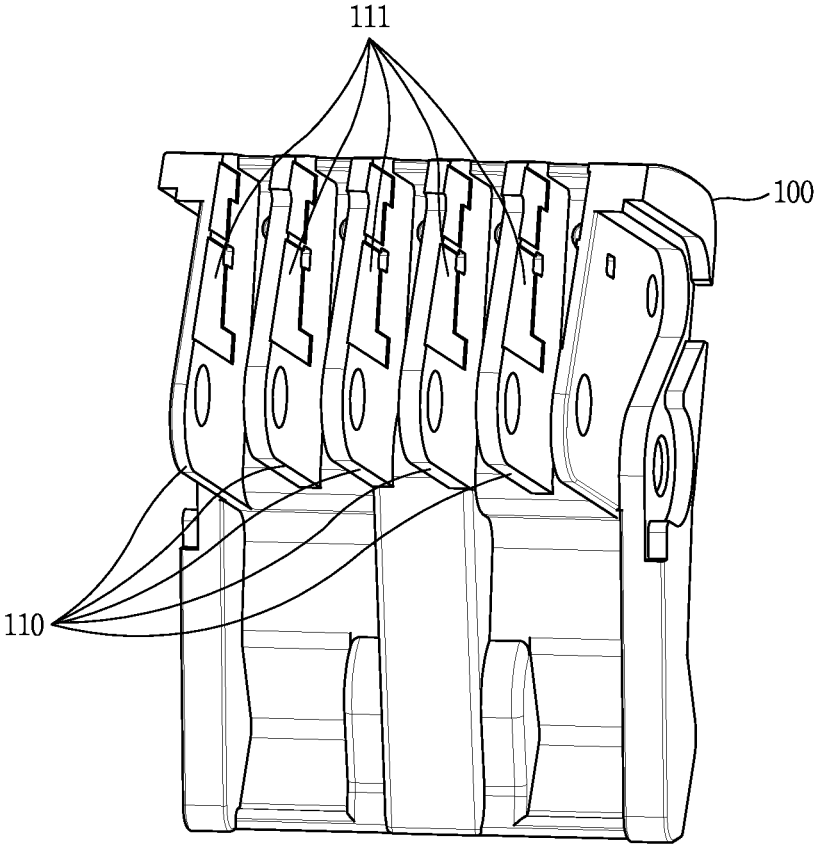
FIG. 9 is a perspective view illustrating an insulating cage provided in an air circuit breaker in accordance with one embodiment of the present invention.
Figure 10:
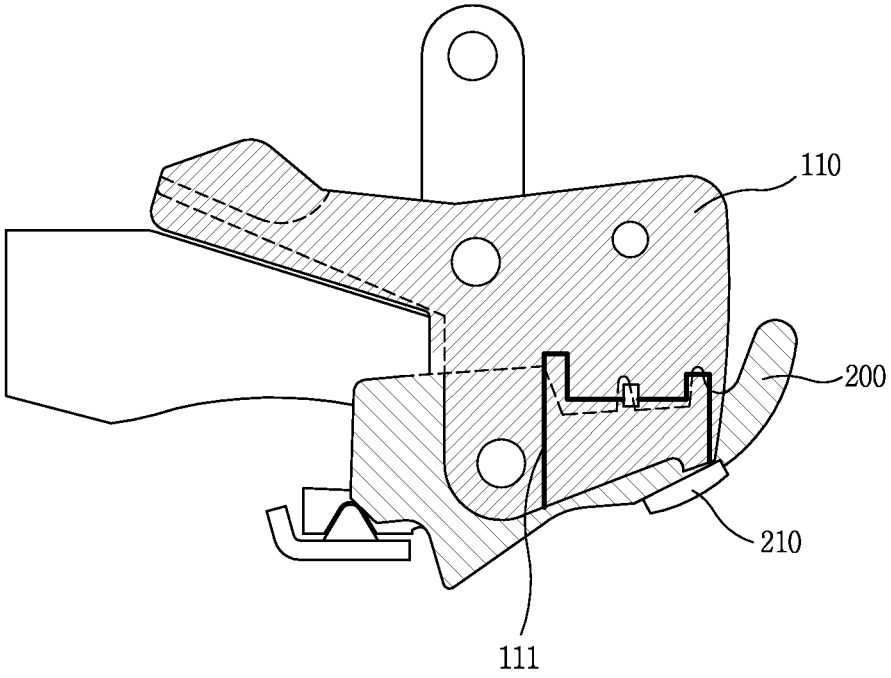
FIG. 10 is a schematic view illustrating relative positions of a movable contactor and a contact plate in a contact state between a movable contact and a fixed contact in the air circuit breaker in accordance with the one embodiment of the present invention.
Figure 11:
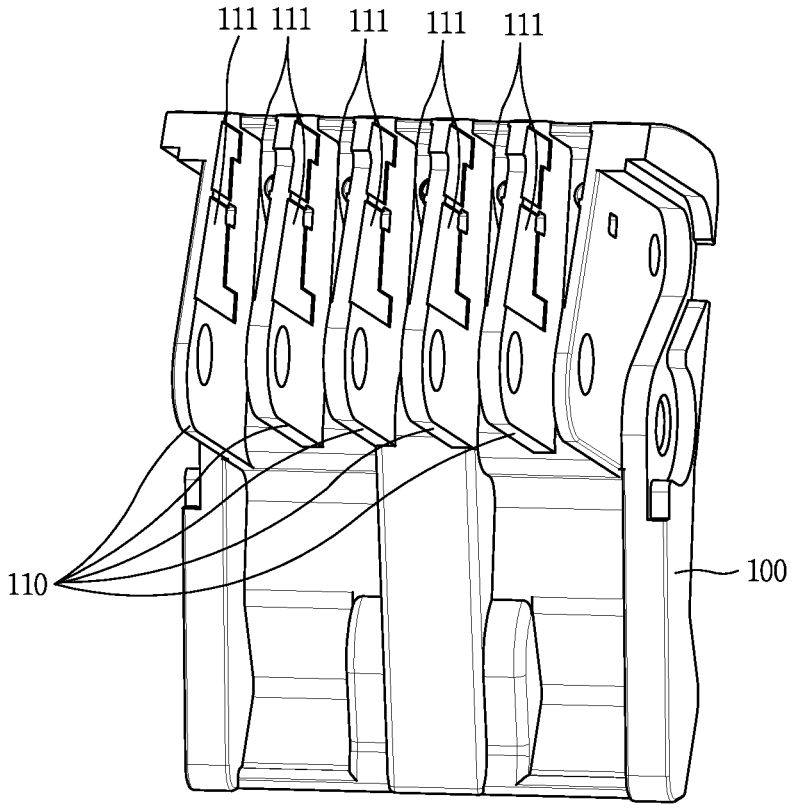
FIG. 11 is a perspective view illustrating contact plates provided in an insulating cage in accordance with another embodiment of the present invention.

FIG. 9 is a perspective view illustrating an insulating cage provided in an air circuit breaker in accordance with one embodiment of the present invention, FIG. 10 is a schematic view illustrating relative positions of a movable contactor and a contact plate in a contact state between a movable contact and a fixed contact in the air circuit breaker in accordance with the one embodiment of the present invention, and FIG. 11 is a perspective view illustrating contact plates provided in an insulating cage in accordance with another embodiment of the present invention.

Also, (a) of FIG. 12 is a perspective view illustrating a state before the contact plates and the insulating case provided in the air circuit breaker according to the one embodiment are coupled to each other, (b) of FIG. 12 is a perspective view illustrating a state where the contact plates and the insulating cage provided in the air circuit breaker according to the one embodiment are coupled to each other, (a) of FIG. 13 is a perspective view illustrating a state before the contact plates and the insulating cage provided in the air circuit breaker according to the another embodiment are coupled to each other, (b) of FIG. 13 is a perspective view illustrating a state where the contact plates and the insulating cage provided in the air circuit breaker according to the another embodiment are coupled to each other, and FIG. 14 is a flowchart illustrating a process of fabricating a breaking part of an air circuit breaker in accordance with one embodiment of the present invention.

As illustrated in FIGS. 9 and 10, the air circuit breaker according to the present invention, similar to the related art air circuit breaker, includes a breaking part (not illustrated) configured to allow a current to flow into or be cut off from the air circuit breaker. The breaking part includes fixed contactors fixed to one side of the breaking part, and movable contactors 200 brought into contact with or separated from the fixed contactors according to an operation of a switching mechanism (not illustrated). Each of the fixed contactors is connected to an input side terminal (not illustrated) through which a current is introduced, and provided with a fixed contact (not illustrated) at one end thereof to be brought into contact with or separated from a movable contact 210.

The breaking part is further provided with an insulating cage 100 having a plurality of contact plates 110, a load side terminal (not illustrated) disposed on one side of the insulating cage 100, and braided wires (not illustrated) disposed within the insulating cage 10, connected to the load side terminal, and arranged in series toward another side of the insulating cage 100.

In addition, the breaking part is provided with contact springs (not illustrated) disposed within the insulating cage 100 and elastically supporting the movable contactors 200.

In this instance, as the air circuit breaker is turned on or tripped (or turned off), the movable contactor is brought into contact with or separated from the fixed contactor, in response to an operation of the switching mechanism. When the air circuit breaker is turned on, the movable contact 210 of the movable contactor 200 is brought into contact with the fixed contact of the fixed contactor. Accordingly, the movable contactor 200 is pushed toward the insulating cage 100 to be inserted between the contact plates and thus brought into contact with the contact plates 110.

Meanwhile, each of the contact plates 110 is provided with a recess 111 to reduce a contact area with the movable contactor 200.

The recess 111 is formed on one side surface of the contact plate 110. When the movable contactor 200 is inserted between the adjacent contact plates 110 to be brought into contact with the contact plates 110, a contact area between the movable contactor 200 and the contactor plate 110 is reduced due to the recess 111. This may result in preventing the contact portion between the movable contactor 200 and the contact plate 110 from being melted due to heat generated at the contact portion.

That is, the air circuit breaker should be maintained in the ON state for a predetermined time even if a fault current is introduced, and accordingly, heat is generated at the contact portions so as to melt the contact portions between the movable contactors 200 and the contact plates 110.

However, according to the present invention, the recess 111 is formed on the one side surface of the contact plate 110 to reduce the contact area at the contact position between the movable contactor 200 and the contact plate 110, thereby preventing the contact portion from being melted due to the generated heat.

In this instance, the recess 111 may be formed on the one side surface of the contact plate 110 or on each of both side surfaces of the contact plate 110.

As illustrated in FIG. 11, when the recess 111 is formed on each of both side surfaces of the contact plate 111, a thickness of the contact plate 110 may be reduced. Therefore, the number of recesses 111 may be adjusted according to a size of the insulating cage 100 or a thickness of the recess 111.

Also, the recess 111 may be formed at a position adjacent to a contact portion between the movable contact 210 of the movable contactor 200 and the fixed contact of the fixed contactor 210 in the contacted state between the movable contactor 200 and the fixed contactor. Since the largest amount of heat is generated at the contact portion between the movable contact 210 and the fixed contact, the recess 111 may be located at a position adjacent to the contact portion, to reduce the contact area of the position which is most affected by the heat generated at the contact portion. Accordingly, the affection due to the heat can be minimized and thus the melting of the contact portion can be prevented more effectively.

In addition, the recess 111 may be inclined inward the contact plate 110 from rear to front sides of the contact plate 110.

That is, since the largest amount of heat is generated at the contact portion between the movable contactor 200 and the fixed contactor, the recess 111 is inclined the most deeply inward the contact plate 110 at the most adjacent position to the contact portion between the movable contactor 200 and the fixed contactor, so as to minimize the affection of the generated heat. Also, an inwardly-inclined degree of the recess 111 is reduced gradually as getting away from the contact portion, thereby preventing the contact portion from being melted due to the heat as much as possible.

Meanwhile, the recess 111 may be configured to have a rectangular or circular section.

That is, the recess 111 may be formed in a shape of a plate (rectangular section) or a cylindrical shape (circular section), and provided in plurality on both side surfaces of the contact plate 110.

In this instance, the recess 111 may be configured such that a depth of the recess 111 changes as extending from rear to front sides of the contact plate 110. Accordingly, the recess 111 is formed the deepest at the contact portion between the movable contactor 200 and the fixed contactor with the greatest amount of heat generated, thereby minimizing the affection of the generated heat. Also, the depth of each recess 111 may be gradually reduced as getting away from the contact portion, thereby preventing the contact portion from being melted due to the heat as much as possible.

In addition, the contact plate 110 and the insulating cage 100 may be made of different materials from each other.

In this instance, the contact plate 110 may be made of a material with relatively higher heat-resistance than the insulating cage 100, to be prevented from being easily melted due to external heat.

That is, the insulating cage 100 may be made of thermoplastic resin such as vinyl chloride resin, acrylic acid resin or poly acetyl resin or the like. The contact plate 110 may be made of thermosetting resin such as phenolic resin, poly ester resin or the like which has higher heat-resistance than the thermoplastic resin.

The thermosetting resin is resin which does not change in shape even though heat is applied again after being molded by applying heat, and exhibits high thermal resistance, solvent resistance, chemical resistance, mechanical property, electric insulating property and the like.

Therefore, the contact plate 110 may be molded by using the thermosetting resin having such properties, thereby being prevented from being melted due to heat.

When molding the contact plate 110, a separate filler may be inserted to reinforce rigidity or other properties of the contact plate 110.

Meanwhile, the insulating cage 100 may be molded by using the thermoplastic resin.

Since the thermosetting resin does not return to a resin state even if heat is applied again after being molded, the contact plate 110 having a simple shape is molded by using the thermosetting resin to be prevented from being melted due to heat. On the other hand, the insulating cage 120 is molded by using the thermoplastic resin facilitated to be molded, such that a complicated shape of the insulating cage 120 can be well implemented without an error.

If the insulating cage 100 is molded using the thermosetting resin, it cannot return to the resin state even though being wrongly molded. Defective products may be created accordingly, thereby drastically increasing fabricating costs.

Furthermore, only the contact plate 110 which is located at a position where heat is mainly generated may be molded by using the thermosetting resin and the insulating cage 100 which is the other portion except for the contact plate 110 may be molded by using the thermoplastic resin through insert-molding. This may result in minimizing the use of the thermosetting resin which is impossible to be recycled and thus preventing in advance an occurrence of an environment-related problem, such as an environmental pollution, due to the thermosetting resin.

When the insulating cage 100 is molded by using PA66 as the thermoplastic resin, the insulating cage 100 reacts with arc heat generated during a breaking operation of the air circuit breaker so as to discharge gas, which improves an arc-extinguishing performance, from the insulating cage 100, resulting in enhancing arc-extinguishing efficiency of the air circuit breaker.

As such, by molding the contact plate 110 using the thermosetting resin, the melting due to heat can be prevented and the occurrence of the environmental problem can be prevented. Also, by molding the insulating cage 100 using the different thermoplastic resin, particularly, PA66, the arc-extinguishing efficiency can be improved. Consequently, by using the different materials upon molding the breaking part, the breaking part can simultaneously have the unique efficiencies belonging to the different materials In addition, the contact plate 110 and the insulating cage 100 may be made of a thermosetting resin composite and a thermoplastic resin composite, respectively.

That is, the contact plate 110 and the insulating cage 100 may be made of thermosetting resin composite and thermoplastic resin composite containing glass fibers or carbon fibers. In this instance, the contact plate 110 can be prevented from being melted due to heat, become lighter and have improved durability.

Also, the insulating cage 100 can be easily molded and have improved durability.

Hereinafter, a method of fabricating the breaking part of the air circuit breaker in accordance with the one embodiment of the present invention will be described in detail, with reference to FIGS. 12 to 14.

First, the contact plate 110 is molded by injecting thermosetting resin into a molding frame having a predetermined shape (S101).

In this instance, the contact plate 110 may be provided with a plurality of contact plates, or be provided with a plurality of contact plates and a contact plate connection member 113 connecting the contact plates to the insulating cage 100.

When the contact plate 110 is formed integrally with the contact plate connection member 113, the contact plate 110 and the contact plate connection member 113 are molded using the thermosetting resin. Afterwards, the insulating cage 100 is molded using the thermoplastic resin by inserting the molded contact plate 110 and contact plate connection member 113.

When the breaking part is molded by constituting the contact plate 110 and the contact plate connection member 113, the total number of components to be used for finally producing the insulating cage 120 is two. Accordingly, an inserting operation of the contact plate 110 and the contact plate connection member 113 is facilitated and the entire structure is simplified.

Also, after molding each contact plate 110' by inserting the thermosetting resin into the molding frame, an insulating cage 100' with the plurality of contact plates 110' therein is molded using the molded contact plates 110' by inserting the molded contact plates 110'.

When the breaking part is molded only by constituting the plurality of contact plates 110' without the contact plate connection member 113, a number of an operation increases but production efficiency of the contact plates 110' is remarkably improved.

According to the present invention having such configuration and operations, the recess 111 may be formed on one side or each of both sides of each contact plate 110 provided in the insulating cage 100 so as to reduce the contact area between the movable contactor 200 and the contact plate 110 when the movable contactor 200 and the contact plate 110 are brought into contact with each other. Accordingly, the contact portion between the movable contactor 200 and the contact plate 110 can be prevented from being melded due to heat generated at the contact portion while a current flows along the contact portion in a state that a fault current has been introduced.

Also, the recess 111 may be located adjacent to the contact portion between the movable contact 210 of the movable contactor 200 and the fixed contact of the fixed contactor, so as to be located at a portion where the greatest amount of heat is generated upon an introduction of a fault current, thereby minimizing an affection of the heat generated at the contact portion to the contact portion between the movable contactor 200 and the contact plate 110.

The recess 111 may be inclined inward the contact plate 110 from rear to front sides of the contact plate 110 so as to increase the inward depth as getting close to the position where the movable contact 210 of the movable contactor 200 and the fixed contact of the fixed contactor are brought into contact with each other, thereby minimizing the affection due to the generated heat.

The contact plate 110 may be made of the thermosetting resin so as to be prevented from being melted due to the heat generated around the contact portion upon the introduction of the fault current.

Since the contact plate 110 can be prevented from being melted, it is possible to prevent a failure of a rotation of the movable contactor 200 due to the movable contactor 200 being fused on the contact plate 110, caused by the melted contact plate 110.

Also, upon the fabrication of the breaking part, the contact plate 110 made of the thermosetting resin may first be molded and the insulating cage 100 made of the thermoplastic resin may finally be molded, thereby facilitating the insertion operation of the contact plate 110.

It should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An air circuit breaker comprising:

an insulating cage provided with a plurality of contact plates;

movable contactors each inserted between the contact plates; and fixed contactors brought into contact with or separated from the movable contactors in response to a movement of the movable contactors, wherein each of the contact plates is provided with a recess, wherein the recess is inclined toward an inside of the contact plates from rear sides of the contact plates to front sides of the contact plates, wherein in a connected state, the movable contactors are pushed toward the insulating cage to be inserted between the contact plates and thus brought into contact with the contact plates, and wherein a middle part of the movable contactors does not contact the contact plates by the recess.

2. The air circuit breaker of claim 1, wherein the recess is formed on each of both side surfaces of the contact plate.

3. The air circuit breaker of claim 2, wherein the recess has a rectangular or circular section.

4. The air circuit breaker of claim 1, wherein the recess is located at a position adjacent to a contact portion between the movable contactor and the fixed contactor in a state that the movable contactor and the fixed contactor are brought into contact with each other.

5. The air circuit breaker of claim 1, wherein the contact plate and the insulating cage are made of different materials from each other.

6. An air circuit breaker comprising:

an insulating cage provided with a plurality of contact plates;

movable contactors each inserted between the contact plates; and fixed contactors brought into contact with or separated from the movable contactors in response to a movement of the movable contactors, wherein each of both side surfaces of the contact plates is provided with a recess, wherein the recess has a rectangular or circular section, and wherein the recess is provided in plurality, and a depth of each of the recesses changes as the recess extends from a rear to front sides of the contact plate.

7. An air circuit breaker comprising:

an insulating cage provided with a plurality of contact plates;

movable contactors each inserted between the adjacent contact plates; and fixed contactors brought into contact with or separated from the movable contactors in response to a movement of the movable contactors, wherein each of the contact plates is provided with a recess, wherein the contact plate and the insulating cage are made of different materials from each other, and wherein the contact plate is made of a material having relatively higher thermal resistance than that of the insulating cage.

8. The air circuit breaker of claim 7, wherein the contact plate is made of a thermosetting or thermoplastic resin composite.

9. The air circuit breaker of claim 7, wherein the insulating cage is made of a thermosetting or thermoplastic resin composite.

* * * * *